US006629403B1

(12) United States Patent
Tisma

(10) Patent No.: US 6,629,403 B1
(45) Date of Patent: Oct. 7, 2003

(54) MANDREL WITH VARIABLE POCKET WIDTHS FOR AUTOMATIC PACKAGING MACHINES

(75) Inventor: Steven Tisma, Elk Grove Village, IL (US)

(73) Assignee: Delaware Capital Formation, Inc., Wilmington, DE (US)

( * ) Notice: Subject to any disclaimer, the term of this patent is extended or adjusted under 35 U.S.C. 154(b) by 0 days.

(21) Appl. No.: 09/694,971

(22) Filed: Oct. 24, 2000

(51) Int. Cl.[7] ..... B65G 17/12

(52) U.S. Cl. ..... 53/502; 53/457; 53/458; 53/381.1; 53/387.2; 493/55; 493/475; 493/478; 493/479; 198/867.05

(58) Field of Search ..... 53/502, 457, 458, 53/381.1, 387.2; 493/55, 475, 478, 479; 83/409, 409.1; 414/753.1; 198/867.05

(56) References Cited

U.S. PATENT DOCUMENTS 3,583,447 A * 6/1971 Peterson ..... 53/186
3,767,025 A * 10/1973 Louis ..... 198/867.05
4,716,714 A * 1/1988 Tisma ..... 53/575
4,790,427 A * 12/1988 Dixon ..... 198/867.05
4,829,751 A * 5/1989 Tisma ..... 53/575
5,072,573 A * 12/1991 Tisma ..... 53/252
5,144,790 A * 9/1992 Tisma ..... 53/251
6,062,799 A * 5/2000 Han et al. ..... 414/416.07
6,374,997 B1 * 4/2002 Spadafora et al. ..... 198/803.11

* cited by examiner

*Primary Examiner*—Rinaldi I. Rada
*Assistant Examiner*—Brian Nash
(74) *Attorney, Agent, or Firm*—Michael Best & Friedrich LLC

(57) ABSTRACT

An automatic packaging machine has mandrels with a plurality of fingers for gripping an object. A cam track has contours which defines the location of positions along a conveyor carrying the mandrels. The fingers are closed by a spring and opened by a cam follower encountering a contour of cam track. This way a plurality of objects having a variety of widths may be carried by the fingers without requiring a readjustment of the machine.

12 Claims, 11 Drawing Sheets

MANDREL WITH VARIABLE POCKET WIDTHS FOR AUTOMATIC PACKAGING MACHINES

This invention relates to mandrels for use on automatic packaging machines and more particularly to mandrels for picking up and carrying products having any of a plurality of different widths.

BACKGROUND

As used herein a mandrel is a device carried by a link chain conveyor of an automatic packaging machine. Usually, it has been necessary to readjust an automatic packaging machine when one type of mandrel is replaced by another type of mandrel.

These mandrels may perform any of many different functions such as carrying boxes, bottles, packets or performing other suitable functions. Usually, each mandrel is especially adapted to perform a specific function. For example, a conventional mandrel which might carry and shape a bag of peas to fit into a frozen food carton, but that same mandrel cannot carry a bottle to receive pills. Heretofore, a mandrel which can carry a box cannot set it down temporarily to weigh its contents, for example, and then pick it up again to complete its trip through the packaging machine.

Heretofore, it has been common practice to design an automatic packaging machine from start to finish, which has been a relatively expensive procedure. The present inventor has designed such packaging machines with a modular construction in order to produce a new automatic packaging machine by selecting and assembling preexisting modules. Therefore, there are existing mandrels and platforms for mandrels which may be selected and used in different configurations. Hence, if a new mandrel is required, there is a savings if that new mandrel can be carried on and supported on an existing platform.

SUMMARY OF THE INVENTION

Accordingly, an object of the invention is to provide mandrels which may carry boxes or other objects of almost any shape or size, within reason. Here an object is to provide such mandrels which can be oriented either horizontally or vertically and which can be changed without having to readjust the basic automatic packaging machine. A further object is to provide mandrels of design which may be easily enlarged or reduced in size, or otherwise modified, with little or no significant amount of original engineering required in order to accommodate different types of end products.

Another object of the invention is to provide new and novel mandrels which can be carried on and operated by existing platforms. Still another object is to provide mandrels which carry a product in a self-holding or locking manner so that no positive and continuous holding force need be applied by the automatic packaging machine. Here, an object is to provide mandrels which are self-holding responsive to a spring force and which are opened responsive to an instantaneous location of said mandrel along the conveyor path.

In keeping with an aspect of this invention, an automatic packaging machine has a conveyor accompanied by a cam track with contours which define work stations and other locations along the conveyor. A variable width mandrel is adapted to carry objects having any of a plurality of different widths. A coiled spring closes the mandrel to grip an object as it travels with the conveyor. The cam track expands the mandrel to release a grip on the conveyed objects. This way, a change in the width of the object being carried does not require a readjustment of the machine. In addition, the machine may drop and retrieve the objects as a function of the cam track contour. For example, the object may be briefly set on a scale to weigh, its content and then picked up and carried on.

The invention will become more apparent from a study of the following specification taken in connection with the attached drawings, in which:

FIGS. 1A–1F schematically illustrate the flexibility of the inventive mandrel;

FIG. 2, taken from U.S. Pat. No. 5,072,573, is a perspective view of a prior art mandrel showing a pre-existing platform which may be used for carrying the inventive mandrel;

FIG. 3, also taken from U.S. Pat. No. 5,072,573, is a perspective view which shows a cam track having contours for opening, closing, and otherwise controlling the mandrel;

FIG. 4, taken from U.S. Pat. No. 5,144,790, is a perspective view which shows a lost motion linkage which facilitates a mandrel's trip around a bend, such as a sprocket wheel in the conveyor;

FIG. 5, also taken from U.S. Pat. No. 5,144,790, is a plan view which shows the lost motion action of the FIG. 4 structure;

DETAILED DESCRIPTION OF THE INVENTION

The goals and motivation for the invention are shown in FIGS. 1A–1F. In each of these figures, there is a support plate 200 that has four oppositely disposed and vertically aligned, elongated tracks or slots 202, 204, 206, 208 which provide tracks in which four outstanding fingers 210, 212, 214, 216 move. Of course, the number four is only an example since any suitable number of tracks or slots and fingers may be provided.

Figure 1A:
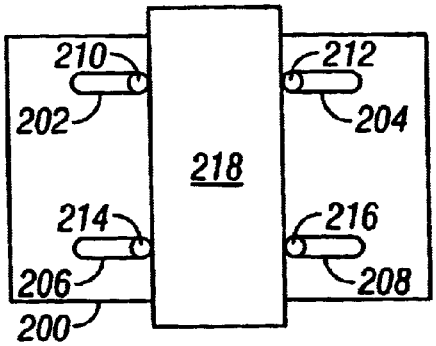

As shown in FIG. 1A, the four fingers such as 210, have moved in toward the center of plate 200 in order to clutch a relatively narrow container or box 218 which is representative of any suitable object that can be clutched and carried between the outstanding fingers.

Figure 1B:
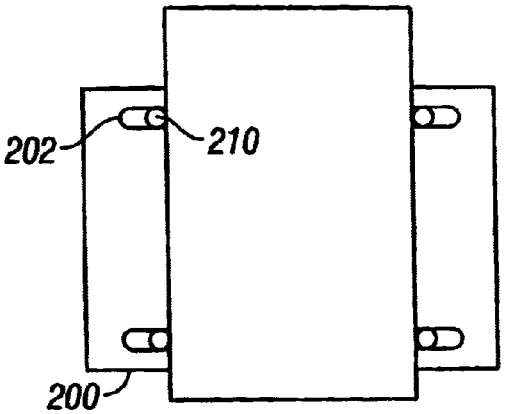

In FIG. 1B, the fingers, such as 210, have moved to a mid-point in the elongated tracks or slots, such as 202, in order to clutch and carry a relatively mid-sized box.

Figure 1C:
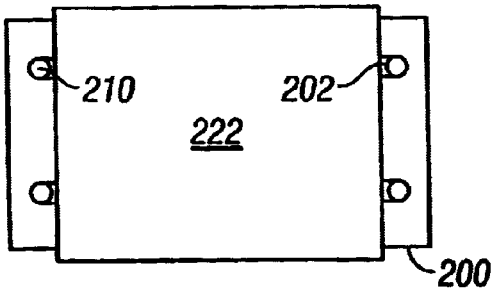

In FIG. 1C, the fingers, such as 210, have moved in the elongated tracks or slots, such as 202, toward the outer vertical edges of the plate 200 in order to clutch and carry a relatively large box 222.

In between the positions shown in FIGS. 1A–1D, the fingers may move to any position in order to clutch any size box. Therefore, the mandrel is for universal use because it may pick up any size box within the travel permitted by the length of the tracks or slots, such as 202. If the end product is tiny or huge, mandrels of different sizes may be provided merely by reducing or enlarging the size of the mandrel parts.

Figure 1D:
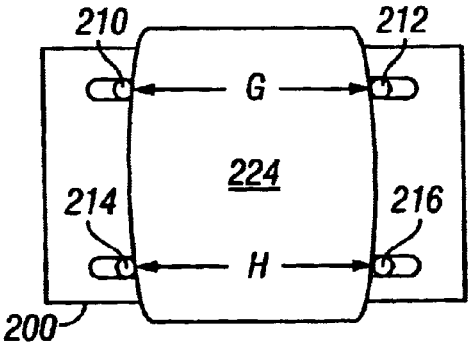

FIG. 1D shows a box 224 having a somewhat barrel-shape, which is exemplary of any unusually or oddly shaped box. Any box is suitably shaped as long as the fingers 210–216 grip the box; or, stated otherwise, width G equals width H. Hence, the mandrel is adapted to open and form a box other than a parallelepiped.

Figure 1E:
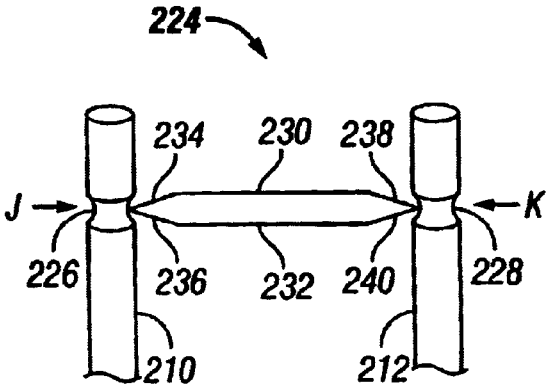

FIG. 1E is a side elevation of the fingers 210–216 shown in plan view in FIGS. 1A–1D, 1F. This figure shows how the barrel-shaped box 224 is formed. More particularly, the blank which forms box 224 is designed so that when squeezed (directions J and K) the box opens into the barrel shape. Each of the fingers 210–216 has a circumferential groove 226, 228 (FIG. 1E) formed thereon.

The blank of box 224 (FIG. 1E) has front and back panels 230, 232 joined on their opposite ends by side half panels 234, 236 and 238, 240, respectively. When the blank 224 is first placed between the grooves 226, 228, the half panels 234, 236 and 238, 240 are closed on each other and are caught and held in place between the fingers 210, 212 and within the grooves 226, 228. When squeezed, the fingers 210, 212 move together in directions J, K, the side half panels 234, 236 expand and become a flat side panel, as do panels 238, 240. The half panels 234, 236 and 238, 240 expand forcing the front and back side panels 230, 232 apart, so that the resulting box assumes the shape that the blank 224 is formed to make, in this case, the barrel-shape box 224.

One point of FIG. 1E is to show that different fingers having different configurations may be screwed into threaded holes in order to perform different functions. Hence various types of fingers may replace other types of fingers quickly and easily.

Figure 1F:
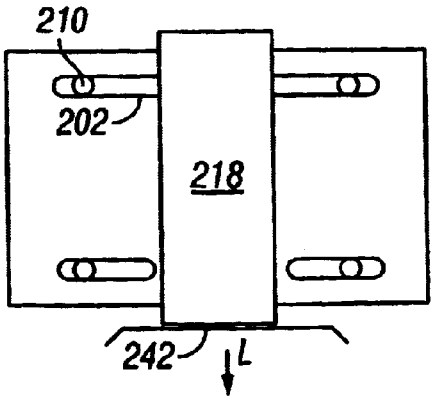

FIG. 1F illustrates an example of the versatility of the inventive mandrel. As shown in FIG. 1A, fingers 210–216 clutch and carry a box 218 through an automatic packaging machine. In FIG. 1F, the box 218 is shown as it passes any suitable one of a plurality of work stations where a scale 242 is located. The fingers, such as 210, move outwardly in slots 202–208 to allow the box 218 to drop under gravity in direction L and be deposited on scale 242. As soon as the scale 242 weighs box 218, fingers, such as 210, move in toward the center in order to again grip and carry the box.

FIG. 1F has been drawn to illustrate a vertical box movement (Direction L) under gravity. However, this vertical motion may be very small and well within the tolerance of the vertical position in which a box may be carried. Therefore, usually there is no need for a scale to raise the box to its original position after the weighing process has ended. Of course, a provision may be made for both raising the boxes and moving the scale as a function of box travel if that should become necessary. Any other suitable functions at many other work stations may be accommodated by dropping and re-gripping the box or other object. Hence, this showing of FIG. 1F is only an example of times when it is desirable to drop and retrieve the box.

Since the invention is built on parts of platforms shown in U.S. Pat. Nos. 5,072,573 and 5,144,790, a few parts of these two patents will be explained here for completeness of this record. During this explanation, the original reference numerals will be used so that it will be easier for the reader to consult the original patents if more information is required.

Figure 2:
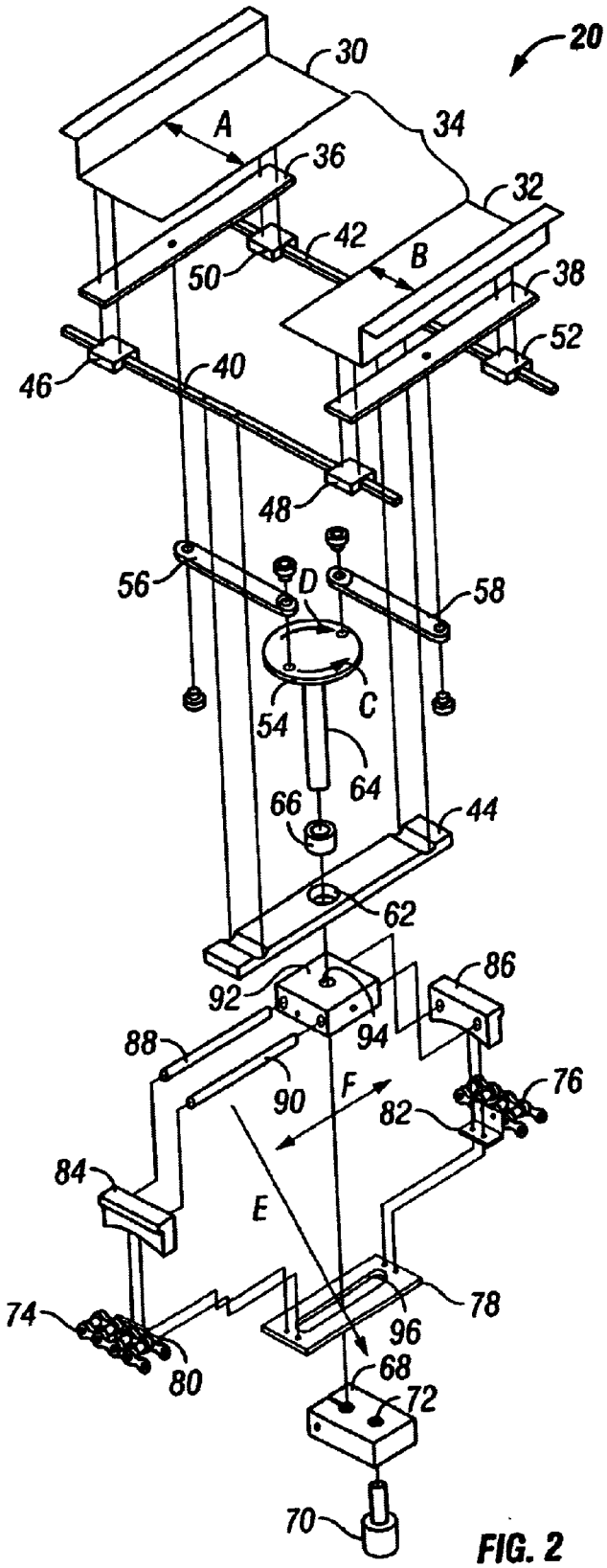
FIG. 2 (Prior Art)

FIG. 2 is taken from U.S. Pat. No. 5,072,573 and shows an exploded view of an embodiment of a mandrel tray 20 having a variable width. It is comprised of two sheet metal side members 30, 32 (with a generally "L-shaped" cross-section) that slidingly fit over each other in the bottom region 34. These side members may slide toward and away from each other, as shown by the arrows A and B, in order to telescope together or apart. The bottoms of side members 30, 32 are bolted to side bars 36, 38. A pair of guide rails 40, 42 are held in a spaced parallel relationship by a support bar 44. Four nylon bearing blocks 46–52 are mounted to slide along the rails 40, 42. The side bars 36, 38 mounted on the nylon bearing blocks 46–52 slide back and forth in directions A, B.

A rotary member 54 is mounted to rotate in a space which is always at the center of the tray, regardless of its width. Pivotally mounted on and extending between rotary member 54 and side bars 36, 38 are two lever arms 56, 58. When the rotary member 54 turns one way (Direction C), the sides 30, 32 of the tray are pulled in by lever arms 56, 58. When the rotary member 54 turns in an opposite direction (Direction D) the lever arms 56, 58 push out the sides 30, 32 of the tray.

The support bar 44, has a journal 62 into which an axle 64 and bearing 66 may fit in order to rotatably support the rotary member 54 which is fixed to the upper end of axle 64. On the opposite or lower end of axle 64 is fixed a cam plate 68. The lower side of cam plate 68 has an upstanding member which is a cam follower roller 70 having an axle that fits into a hole 72 in the bottom of cam plate 68. Therefore, as the cam follower 70 turns rotary member 54, the lever arms 56, 58 move and the tray side members 30, 32 slide back and forth on the rails 40, 42 in order to adjust their width.

A pair of conveyor chains 74, 76 are, broadly speaking, about the same as conveyor of U.S. Pat. No. 4,829,751. They carry the mandrel 20 formed by the tray 30, 32 along a predetermined path represented by Arrow E. A plate 78 extends between conveyor chains 74, 76 and is bolted thereto by brackets 80, 82. Also mounted on brackets 80, 82 are slide bar supports 84, 86. Spaced, parallel slide bars 88, 90 extend between supports 84, 86. A sliding member 92 slides back and forth (Directions F) on the bars 88, 90. The axle 64 of rotary member 54 fits through hole 94 in block 92 and slides within slot 96 in plate 78. Thus, the cam follower 70 has a continuous control over the rotary position of member 54 and, therefore, the width of the tray 30, 32 throughout the entire excursion through the automatic packaging machine.

Figure 3:
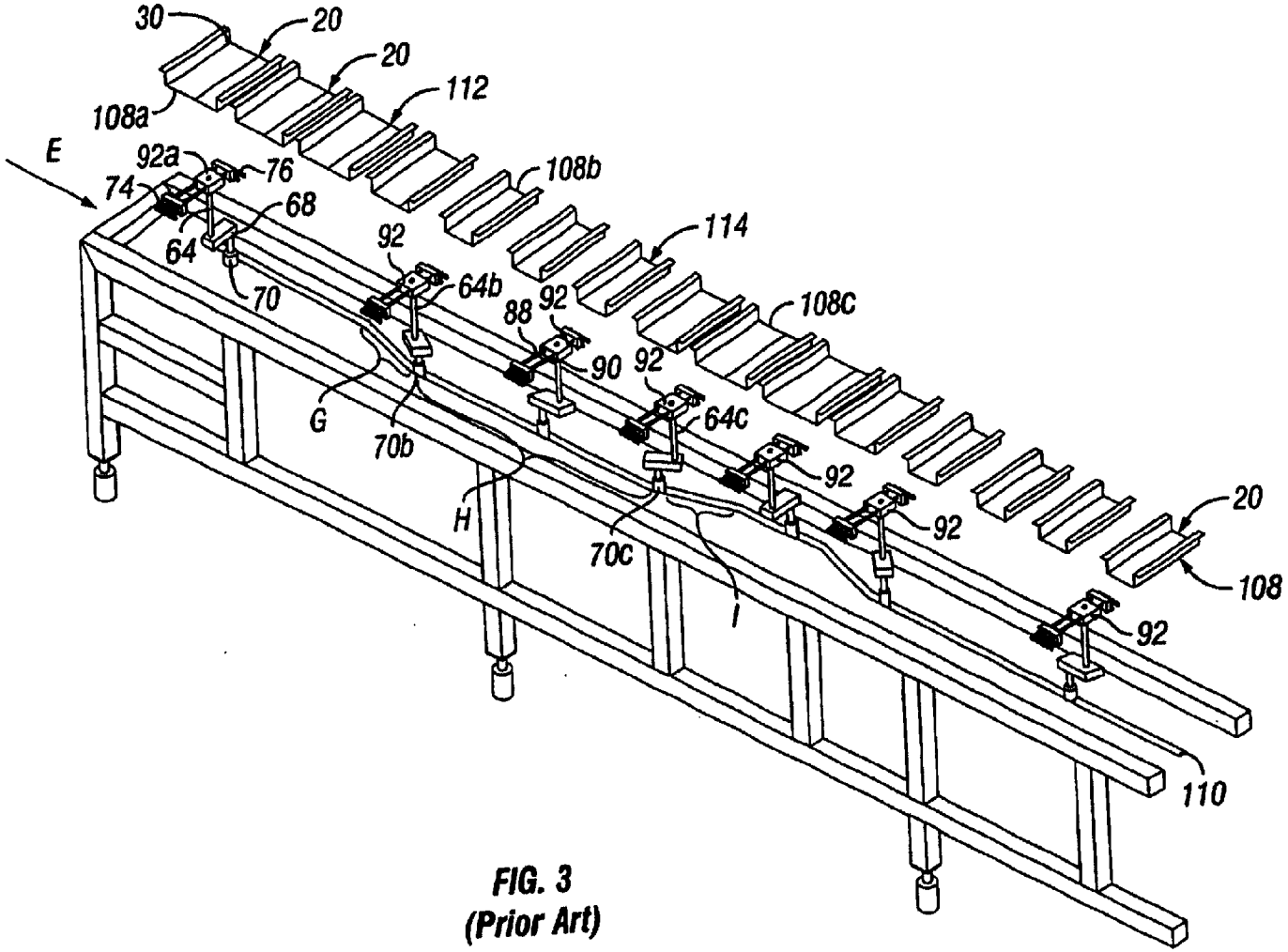
FIG. 3 (Prior Art)

FIG. 3 is an exploded view which illustrates how the width of the tray changes as a function of its instantaneous position as it travels along its path E through conveyor 148. More particularly, the conveyor chains 74, 76 (FIG. 2) extend continuously along and on opposite sides of the travel path Direction E. Attached periodically to the chains 74, 76 are a plurality of the carriages seen in FIG. 2, a few of which are identified at 92, 92 . . . 92 in FIG. 3. To avoid a confusion caused by a clutter of parts, only a few of the carriages 92 have been shown and many of the parts of automatic packaging machine are eliminated. Each carriage 92 has a tray 20 individually associated therewith. By way of example, tray 108*a* is here shown as being individually associated with carriage 92*a*.

Extending generally down the center of the conveyor is a cam track slot 110 having contours in which each of the cam followers 70 rides. The cam follower will adjust the width of the mandrel as a function of the instantaneous position of the mandrel as it travels along the conveyor. More particularly, as the cam followers 70 move into the contour of the cam track at Position G, for example, the cam follower 70*b* rotates the axle 64*b* to one position in order to move the sides of the tray relatively close together and to make a narrow tray 108*b*. When the cam slot 110 moves the cam follower 70*c* to a new position, the axle 64*c* rotates as it follows the contour of the cam track at I, and the tray 108*c* becomes relatively wider. It should be noted that the contours such as at G and H match functional locations along the conveyor (e.g., narrow tray at G, wide tray at I).

The angle at which the cam track slot 70 bends determines how violently or how gently the sides move together or apart. If the track moves back and forth with a small angular change of slot direction, the sides may gently pat the product into shape. Of course, a large angular change of slot direction could rather violently whack the product, if that is desired.

The principle is that the tray is made wider in the position 112 where the product is deposited in it. Then, as the tray approaches a location where the product is to be inserted into a box, the tray becomes more narrow shaping the product. At a loading position 114, the block 92 slides on rails 88, 90 to project the tray forward and thrust the product into a box. As the empty tray moves away from the loading position, it again becomes wider as it approaches another loading position.

Figure 4:
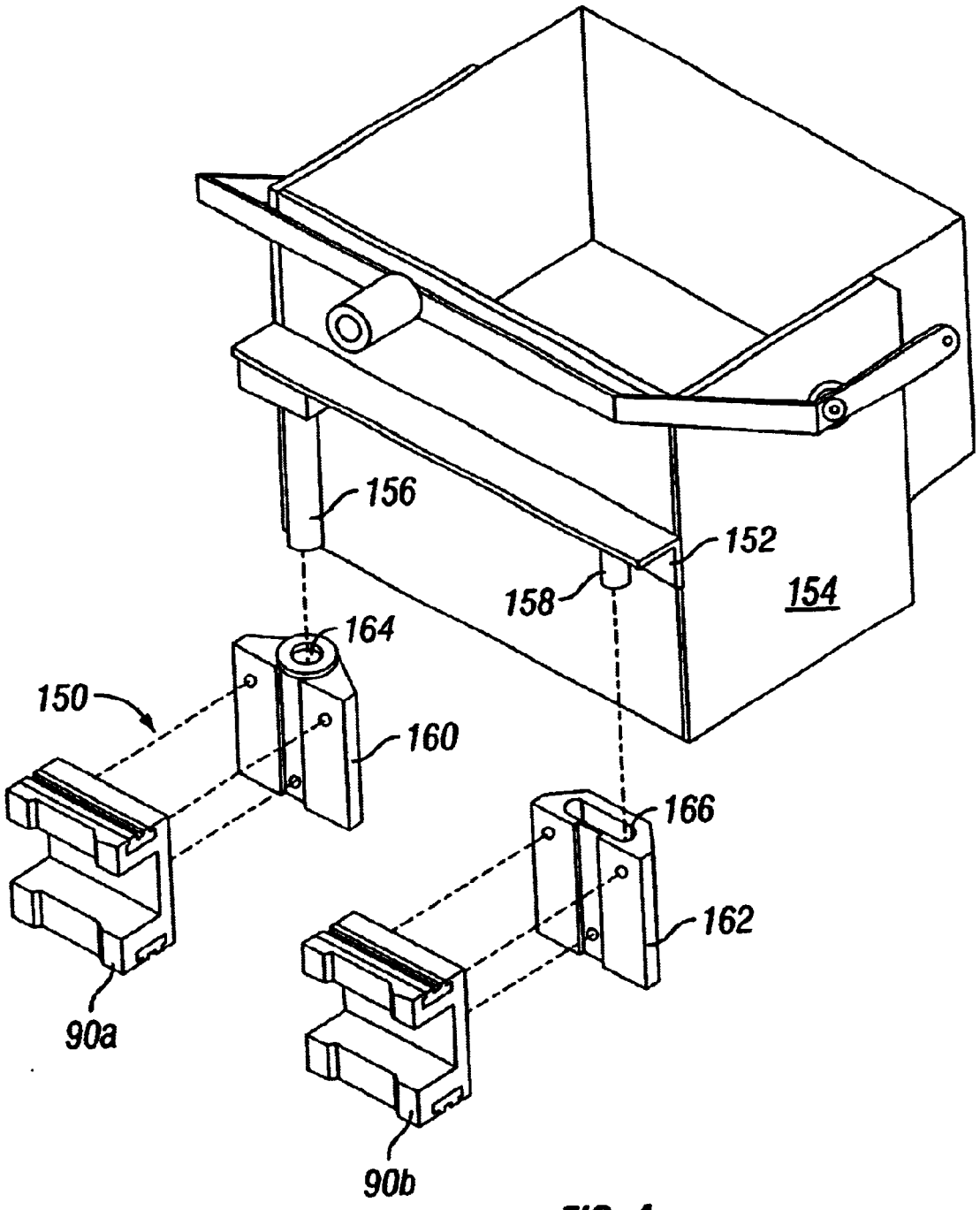
FIG. 4 (Prior Art)

Means are provided for giving a lost motion which assists the mandrel to travel smoothly around a curved track, such as at a sprocket wheel, for example. More particularly, the connector 150 (FIG. 4, U.S. Pat. No. 5,144,790) copes with the centrifugal forces acting upon the mandrel as it goes around a curve. In greater detail, as best seen in FIG. 4, an angle iron 152 is bolted across the back of the mandrel 154. Dependent from the angle iron 152 is a pivot pin 156 on one side of the mandrel 154 and a guide pin 158 on the other side of the mandrel 154. Two of the slide block pieces of metal 90*a* and 90*b* are bolted to the conveyor chain at positions corresponding to the space between pivot and guide pins 156, 158. A pivot block 160 is bolted to slide block 90*a*. A guide block 162 is bolted to slide block 90*b*. The pivot block 160 has a hole 164 for receiving pivot pin 156, thereby making a hinge connection between the leading edge of the mandrel 154 and the conveyor chain. The guide block 162 includes a slot 166 which is long enough to provide lost motion responsive to travel of the guide pin as the mandrel traverses the circular path at 134 (FIG. 5).

Figure 5:
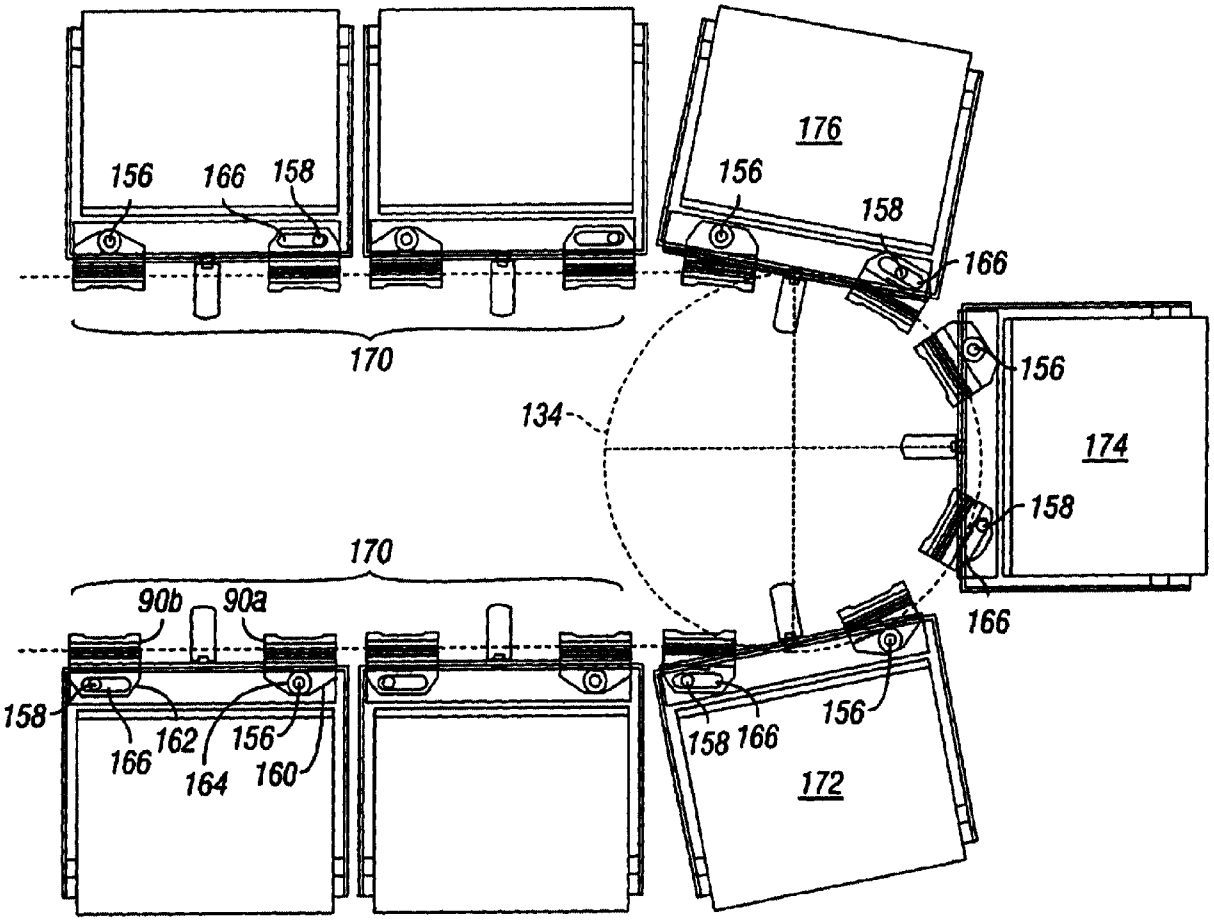
FIG. 5 (Prior Art)

The operation of the connector 150 of FIG. 4 is seen in FIG. 5. In the two regions 170, 170 the mandrels are following a straight section of the transport path, being pulled along by pivot pin 156 and with guide pin 158 in the trailing end of slot 166. When the mandrel 172 reaches the circular section 134 of the transport path, it is still being pulled by the pivot pin 156 while the guide pin 158 moves to the center of guide slot 166. At the center of the circular path 134, the mandrel 174 is being pulled by pivot pin 156, while guide pin 158 has moved to the leading end of guide slot 166. As the mandrel 176 moves back onto the straight section 170 of the transport path the guide pin 158 is moving back through the slot 166, to the trailing edge thereof.

The point of FIG. 5 is that the two ends of the mandrel are always tied to the conveyor chain, but that there is a lost motion on the curved part of the conveyor so that there is none of the whipping back an forth which occurs as a mandrel with no lost motion is pulled around the circle 134. When the mandrel returns to the straight section 170 the restoring force is minimal because the pins 156, 158 are held in close proximity to and do not substantially depart from the transport path.

A feature of the invention is that the inventive variable width mandrel (FIG. 1) uses the platforms described above in (FIG. 2). Therefore, there is a savings of cost and of both engineering and manufacturing time.

Figure 6:
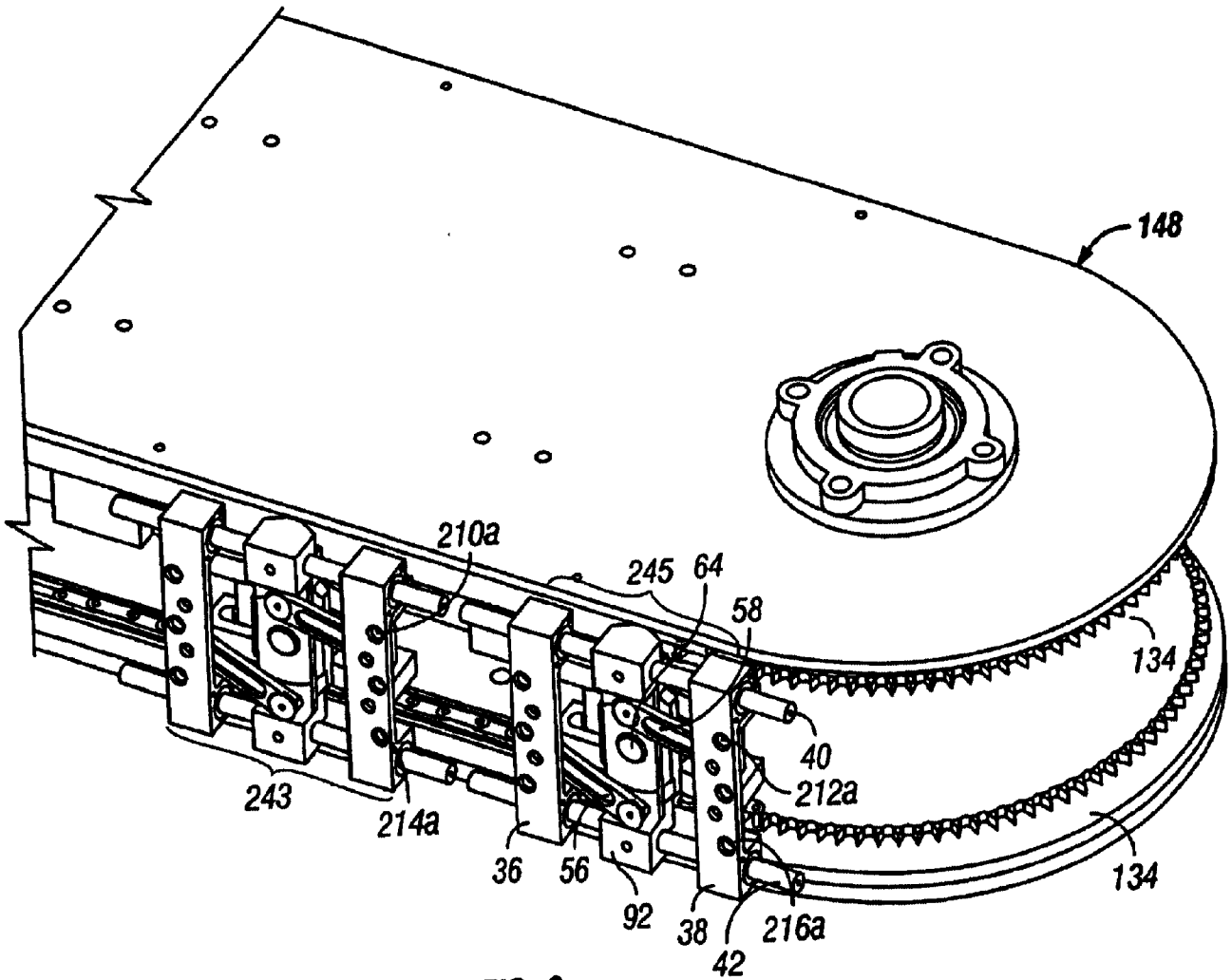
FIG. 6, is a perspective view which shows sprocket wheels at the end of a conveyor and which shows two of the platforms of FIG. 2 as they are adapted to carry the inventive mandrel.

FIG. 6 shows the platform of FIG. 2 mounted on a conveyor 148 before the inventive mandrel is added thereto. The same reference numerals are used in FIG. 6 to identify the parts that are shown in FIG. 2. For clarity and simplicity of the figure, many of the conveyor parts, such as chains 74, 76 (FIG. 2), are not shown in FIG. 6. Conveyor chains are trained over sprocket wheels 134, 134. The parts which are shown are the sprocket wheels 134, for the conveyor chains 74, 76 (FIG. 2) and two platforms 243, 245 for supporting and manipulating the inventive mandrel. In this example, the platforms 243, 245 are mounted to hold the transported objects or boxes in a vertical orientation. If it is desirable to hold the objects or boxes in a horizontal orientation, the entire conveyor 148 is rotated by 90°.

Figure 7:
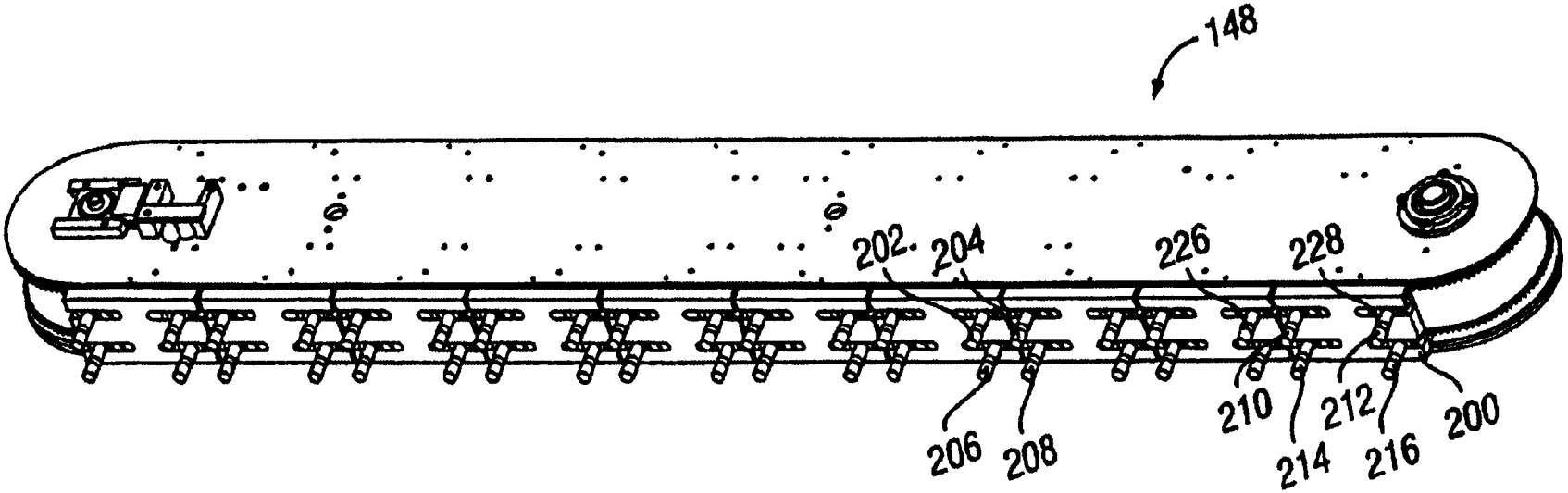
FIG. 7, is a perspective view which shows the conveyor of FIG. 6 with the inventive mandrel added to the preexisting platform.

FIG. 7 expands upon FIG. 6 by adding plate 200 of the inventive mandrel carrying fingers 210–216 (FIG. 1A). The support plate 200 is bolted to the block member 92 (FIGS. 2 and 6). The fingers 210–216 have threaded ends which are mounted by screwing them through slots, such as 202 in FIG. 1A, on the support plate 200 and into holes 210*a*–216*a* (FIG. 6) on side bars 36, 38 of the platform.

It should now be apparent that the fingers 210–216 (FIG. 1A) will move together and apart as shown in FIGS. 1A–1F in the same manner that mandrel tray parts 30, 32 (FIG. 2) move together or apart as the mandrel travels along conveyor 148 and cam follower 70 travels in cam track 110.

Figure 8:
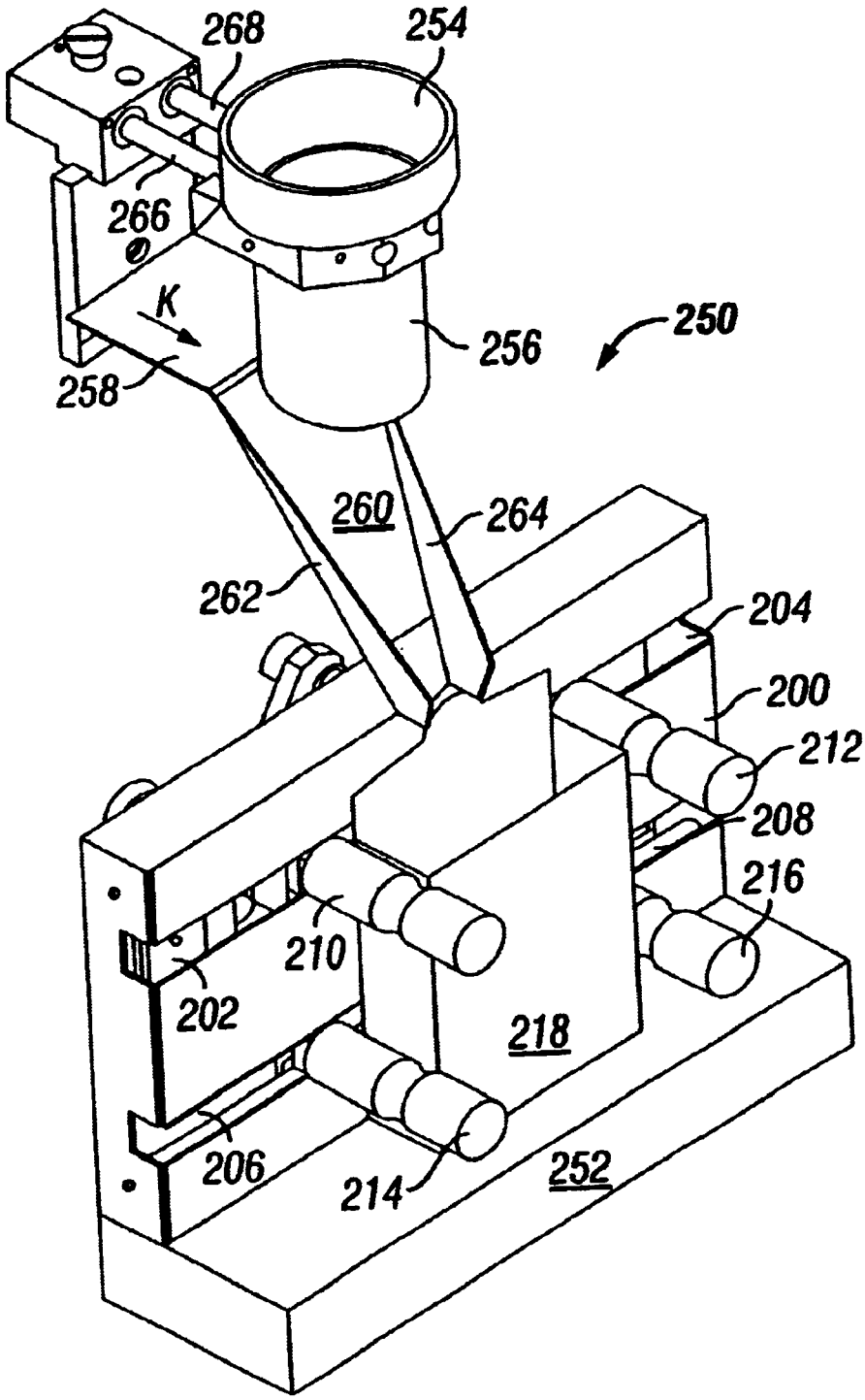
FIG. 8, is a perspective view of a work station which illustrates a use of the inventive mandrel.

FIG. 8 shows an example of how the conveyor of FIG. 3 might be associated with other equipment at a work station in the automatic packaging machine. As here shown, a narrow box 218 has been carried to a fill station while in the clutch of fingers 210–216. In this particular example, the box is resting on a shelf 252 at the bottom of the mandrel. This shelf 252 might or might not be required. It is provided here in order to show a support for a product which is heavy or which has a characteristic that might otherwise knock the box 218 out of the grip of fingers 210–216.

As here shown, a product may be dropped through a somewhat funnel-shaped member 254 and into a bottomless cup 256 resting on a platform 258. An inclined chute 260 attached to platform 258 and having upturned edges 262, 264 is positioned over open box 218. When the box 218 is under the chute 260, bottomless cup 256 is pushed outwardly in Direction K sliding on bars 266, 268 so that the product in the cup slides off platform 258, down the chute 260, and into the box 218. An advantage of the chute 260 construction is that the product is not dropped through a closed tube which might choke or otherwise fail, perhaps as a result of a puff of air being forced out of the box by the falling product.

FIG. 8 is only one example showing the utility of the mandrel. Many other examples could also be shown.

Figure 9:
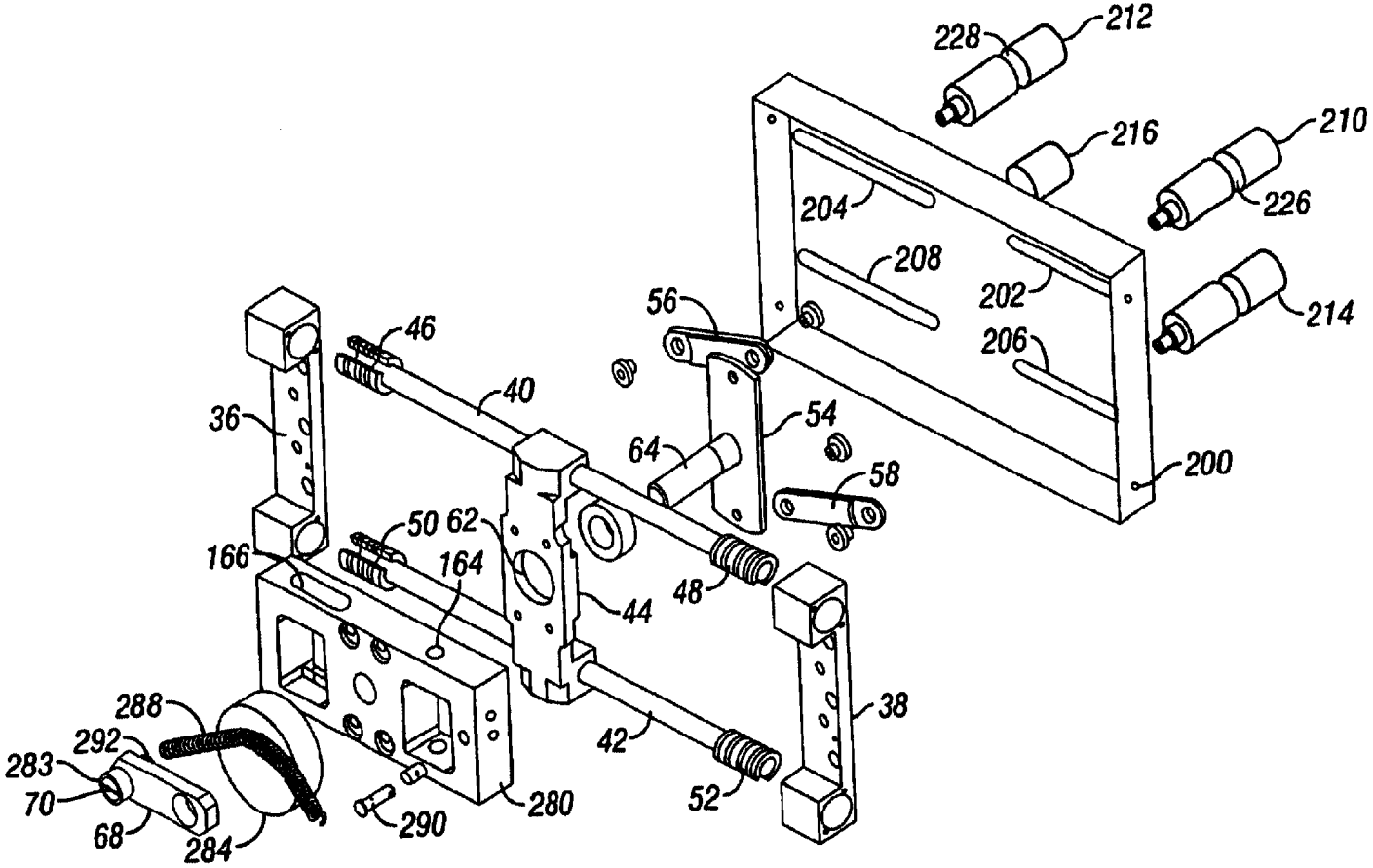
FIG. 9 is an exploded view, in perspective, of the inventive mandrel.
Figure 10:
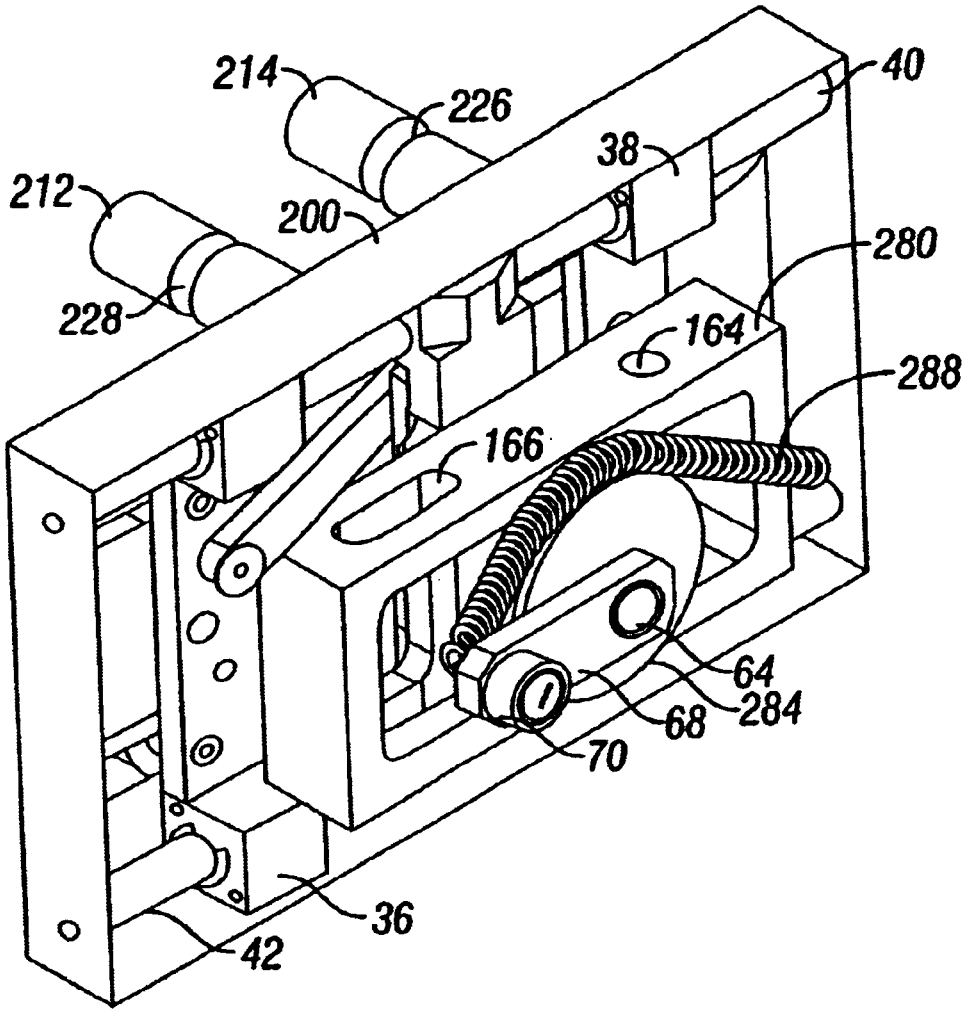
FIG. 10, is a back view, in perspective, of the inventive mandrel which shows the mechanism for gripping a narrow box responsive to the pull of a coiled spring.
Figure 11:
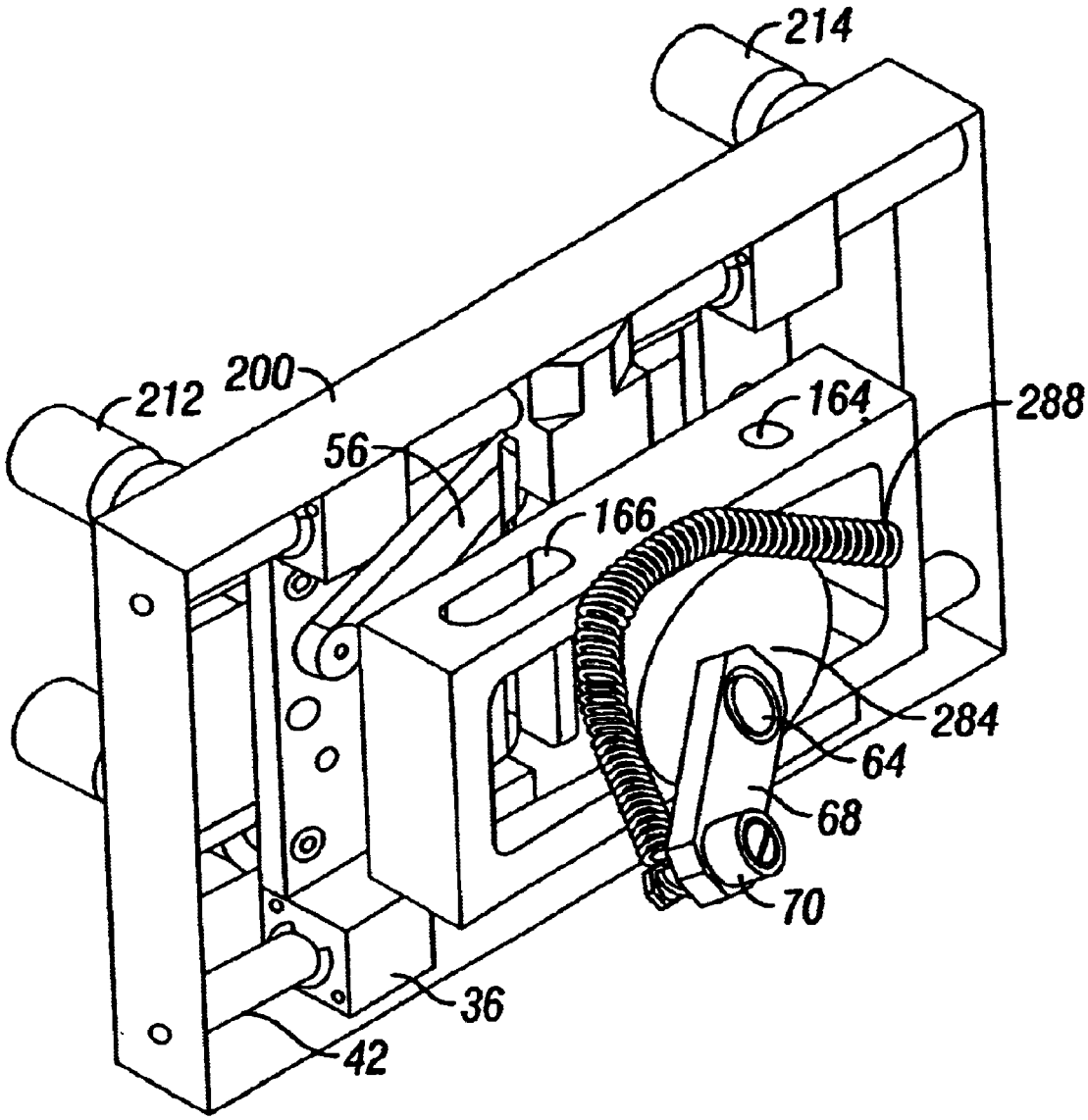
FIG. 11, is also a back view, in perspective, of the inventive mandrel which shows the inventive mandrel opened under the control of a contour in the cam track.

FIG. 9 is an exploded view and FIGS. 10 and 11 show the back of the inventive mandrel in two exemplary positions. These FIGS. 9–11 use the reference numerals of FIG. 2 for corresponding parts. Mounting bar 280 has hole 164 and slot 166 and is secured to the back of the plate 200 and thus to the inventive module in order to provide the lost motion which enables the mandrel to smoothly circle the track, especially around sprocket wheels 134, 134.

The cam follower 70 is mounted on and secured to shaft 64 by set screw 283. Follower 70 rotates the cam plate or arm 68 responsive to contours of cam track 110 (FIG. 3). As cam plate 68 rotates, pins 210–216 move outwardly or inwardly, as described in connection with FIGS. 1A–1F.

A freely turning pulley wheel 284 is positioned between the cam plate 68 and the mounting bar 280. The coiled spring 288 is trained between an anchor point 290 on plate 200 and an outer end 292 of cam plate 68. The coiled spring 288 stretches over freely turning pulley wheel 284, which acts as a former for supporting the spring 288.

Means are provided for gripping the object within the clutch of fingers 210–216 responsive to a spring applied force. More particularly, initially, cam plate or arm 68 is shown (FIG. 10) in a state where the fingers 210–216 are relatively close together in order to clutch a narrow box; as shown in FIG. 1A. This state occurs when cam follower 70 tracks a divergent contour in the cam track, perhaps as shown at G in FIG. 3. The coiled spring stretches over a relatively small arc at the circumference of pulley wheel 284. The tension in spring 288 pulls the fingers 210–216 to a closed position which grips the narrow box. There is no need for applying a force outside the mandrel to hold the grip on the box.

Means are provided for opening the grip of the fingers and releasing the object being carried by the mandrel. In greater detail, FIG. 11 shows essentially the same structure that is shown in FIG. 10. However, here the cam follower 70 has tracked a divergent contour in the cam track 110, perhaps as shown at I in FIG. 3. The coiled spring 288 has been stretched and formed over a relatively large arc of pulley 284, as shown in FIG. 11. The pulley 284 is free to turn as may be required by the motion of spring 288. Responsive thereto, the fingers 210–216 are moved widely apart to release their grip on an object being carried by the mandrel.

Again the tension in the coiled spring pulls in the fingers 210–216 to grip a box and the force for gripping and holding the box comes from the tension in coiled spring 288. There is no need to supply a box holding force from a location outside the mandrel. The force holding the grip on the box is removed when the cam follower 70 moves as shown in FIG. 11, responsive to the contour of the cam track.

Hence, the spring 288 applies the grip to the object being carried and the cam track opens the grip. This way, the contours of the cam track do not have to be changed to match the size of the various widths of objects that are carried. Thus, small boxes, for example, may be carried on one run of the machine. Wide boxes may be carried on the next run of the same machine. In fact, it is possible to carry a plurality of objects having different widths on the same run of the machine. There is no need to readjust the machine between two runs.

The many advantages of the invention should now be clear. The inventive mandrel accommodates a great variety of boxes. A maximum amount of existing hardware is used to avoid costly engineering, tooling, inventory control, and the like. The box may be set down and picked up while being carried by the conveyor to provide for a variety of different functions, such as weighting a box to insure that each box has the same correct amount of product. There is no need to readjust the packaging machine every time that a new box size is run through the machine. Removable fingers of one design may be replaced by fingers of another design in order to accomplish special functions, such as forming odd-shaped boxes, for example.

Those who are skilled in the art will readily perceive various modifications which may be made without departing from the scope and spirit of the invention. Therefore, the appended claims are to be construed to include all equivalent structures.

The claimed invention is:

1. In an automatic packaging machine, a mandrel comprising a support plate having at least two pairs of elongated tracks, said pairs of elongated tracks being oppositely disposed, said elongated tracks of each pair being vertically aligned, a finger mounted to travel on each of said elongated tracks of said support plate, a cam follower means for traveling in a cam track extending along a conveyor in said automatic packaging means, said cam track having contours which guide and direct said cam follower as a function of an instantaneous position of said mandrel as it travels along said conveyor, means responsive to said cam follower for moving said fingers on said tracks, and spring means for pulling said fingers to grip an object between said fingers, movement of said cam follower means along said contours opening said grip and said spring means closing said grip, wherein said object is a box and each of said fingers has a circumferential groove located to grip and squeeze opposite edges of a blank for forming said box, said blank expanding to form an oddly non-parallelepiped shaped box responsive to said squeeze.

2. The mandrel of claim 1 wherein said oddly non-parallelepiped shaped box is a barrel-shaped box.

3. In an automatic packaging machine, a mandrel comprising a support plate having at least two pairs of elongated tracks, said pairs of elongated tracks being oppositely disposed, said elongated tracks of each pair being vertically aligned, a finger mounted to travel on each of said tracks of said support plate, a cam follower means for traveling in a cam track extending along a conveyor in said automatic packaging means, said cam track having contours which guide and direct said cam follower as a function of an instantaneous position of said mandrel as it travels along said conveyor, means responsive to said cam follower for moving said fingers on said tracks, and spring means for pulling said fingers to grip an object between said fingers, movement of said cam follower means along said contours opening said grip and said spring means closing said grip, a freely turning pulley wheel mounted on said mandrel, said spring means being a coiled spring stretched over said pulley wheel responsive to said travel of said cam follower, and means responsive to the tension of said spring stretched over said pulley wheel for closing said grip.

4. An automatic packaging machine comprising a conveyor for moving a plurality of object carrying mandrels around a closed path, a cam track accompanying said path, said cam track having contours which define functional locations along said path, each of said mandrels having a plurality of fingers which move variable distances together or apart in order to grip or release one of a plurality of objects having different widths, means responsive to said contours of said cam track for causing said fingers to release said object, spring means for causing said fingers to grip said object, whereby objects of different widths are selectively carried by said mandrels without requiring a readjustment of said machine, and at least one work station located adjacent said conveyor, said means responsive to said contours causing said fingers to release said object and said spring means causing said fingers to reapply said grip to said object in at least one of said locations, whereby a function may be performed on said object at said one location without interference resulting from said grip on said object.

5. The automatic machine of claim 4, further comprising means for weighing said object by positioning said object on a scale while said grip is released and before said grip is reapplied, whereby a net weight of a product associated with said object may be confirmed for each object that is carried through said machine by said mandrel.

6. An automatic packaging machine comprising a conveyor for moving a plurality of object carrying mandrels around a closed path, a cam track accompanying said path, said cam track having contours which define functional locations along said path, each of said mandrels having a plurality of fingers which move variable distances together or apart in order to grip or release one of a plurality of objects having different widths, means responsive to said contours of said cam track for causing said fingers to release said object, spring means for causing said fingers to grip said object, whereby objects of different widths are selectively carried by said mandrels without requiring a readjustment of said machine, wherein said mandrels further include a support plate having at least two pairs of elongated slots, said pairs of elongated slots being oppositely disposed, said elongated tracks of each pair being vertically aligned, each finger being movable in an associated elongated slot, means including a spring for pulling said fingers toward a center of said support plate in order to grip said object, and means responsive to a cam follower for moving said fingers away from the center of said support plate to release said grip in response to said contours of said cam track.

7. An automatic packaging machine comprising a pair of conveyor chains forming a closed path through said machine, a cam track extending between said conveyor chains and along said closed path, said cam track having contours which define work station locations on said path through said machine, a cam follower for following said cam track, a plurality of mandrels carried by said pair of conveyor chains and controlled by said cam follower, each of said mandrels having a plurality of replaceable fingers for gripping and releasing an object, means including a spring for pulling said fingers to grip said object, and means responsive to said cam follower and said contours of said cam track for enabling said spring means to apply said grip and for overcoming said spring means for opening said fingers and releasing said grip on said object, wherein each of said fingers has a circumferential groove for supporting a blank for a non-parallelepiped box, said spring means pulling said fingers for opening said non-parallelepiped box.

8. A mandrel for use in an automatic packaging machine, the automatic packaging machine including a conveyor having a cam track, the cam track having contours, the mandrel comprising:

a support plate defining two pairs of elongated slots, the pairs being oppositely disposed, said elongated slots of each pair being vertically aligned;

a finger movably supported in each of said elongated slots;

a cam follower supported to travel in the cam track and along the contours, said cam follower being guided by the contours as a function of an instantaneous position of said mandrel as said mandrel travels along the conveyor; and a spring operable to close said fingers to grip an object between said fingers, movement of said cam follower along the contours of the cam track overcoming a force of said spring to open said fingers.

9. The mandrel of claim 8, wherein said fingers grip the object at any position along said elongated slots responsive to the spring being enabled by said cam follower traveling in the cam track.

10. The mandrel of claim 8, wherein each finger defines a circumferential groove to grip and squeeze opposite edges of a blank to form the object.

11. The mandrel of claim 10, wherein the object is an oddly shaped box, and wherein said fingers grip and squeeze opposite edges of the blank to form the oddly shaped box.

12. The mandrel of claim 11 wherein the oddly shaped box is a barrel-shaped box, and wherein said fingers grip and squeeze opposite edges of the blank to form the barrel-shaped box.

* * * * *